United States Patent [19]

Linnhoff et al.

[11] 4,154,538

[45] May 15, 1979

[54] LOADING AND UNLOADING STATION FOR THE CHEMICAL AND/OR ELECTRO-CHEMICAL TREATMENT OF MASS-PRODUCED PARTS CONTAINED IN A ROTATABLE DRUM

[75] Inventors: Paul Linnhoff; Eduard Kaluza, both of Iserlohn, Fed. Rep. of Germany

[73] Assignee: Firma Wilhelm Linnhoff oHG, Hemer, Fed. Rep. of Germany

[21] Appl. No.: 750,757

[22] Filed: Dec. 15, 1976

[30] Foreign Application Priority Data

Dec. 20, 1975 [DE] Fed. Rep. of Germany ..... 2557592

[51] Int. Cl.[2] ..... B01F 9/02; B01F 15/02

[52] U.S. Cl. ..... 366/188; 366/193; 366/234; 204/213

[58] Field of Search ..... 259/81 R, 81 A, 89, 259/90, 3, 14, 30, 57; 51/164 R, 164 P; 68/210; 204/213; 366/188, 192, 193, 234, 220

[56] References Cited

U.S. PATENT DOCUMENTS

| | | | |
|---|---|---|---|
| 2,964,300 | 12/1960 | Lisowski | 259/81 |
| 3,011,327 | 12/1961 | Brownell | 68/210 |
| 3,134,203 | 5/1964 | Roberts | 259/81 |
| 3,484,360 | 12/1969 | Sandrock | 259/89 |

*Primary Examiner*—Robert W. Jenkins

*Attorney, Agent, or Firm*—Allison C. Collard; Thomas M. Galgano

[57] ABSTRACT

A loading and unloading station for the chemical and-/or electro-chemical treatment of mass-produced parts contained in a rotatable drum, the rotatable drum having a cover which is displaceable in a direction parallel to its axis in a controlled, pre-determined, angular position by means of a pressure cylinder, to open or close a filling aperture.

7 Claims, 5 Drawing Figures

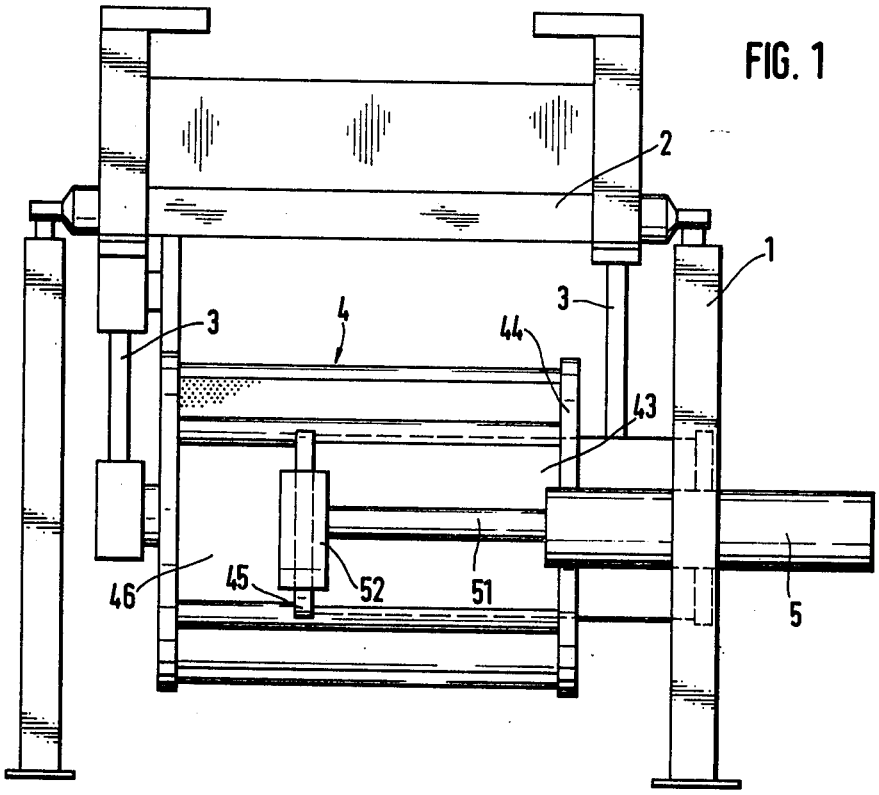
FIG. 1
FIG. 2
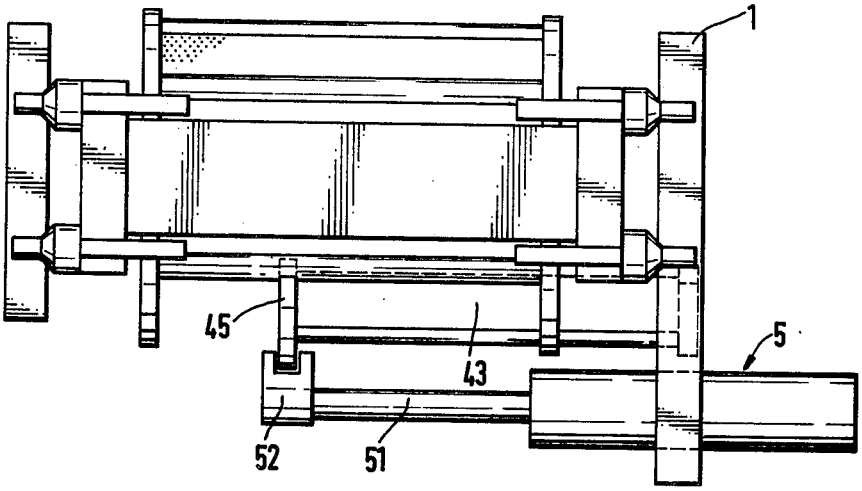

43
44
41
42
II
II
4
45
I
I
46

LOADING AND UNLOADING STATION FOR THE CHEMICAL AND/OR ELECTRO-CHEMICAL TREATMENT OF MASS-PRODUCED PARTS CONTAINED IN A ROTATABLE DRUM

The present invention relates to a loading and unloading station for the chemical and/or electro-chemical treatment of mass-produced parts in a rotating drum, the cover of which may be automatically opened or closed. In such installations the drum, which is arranged in a supporting base and is power driven, is transported, together with the supporting base, to a plurality of treatment stations. For example, this supporting base can be moved to a plurality of baths provided in series. At a loading and an unloading station, the drum has to be opened before being loaded with mass-produced metal parts or unloaded. For this purpose drums are known in which the cover can be hinged open manually.

However, a treatment drum is also known for immersion baths, which has a filling and evacuating opening in the cover closing the drum cylinder and is characterised by a reversably driven drum cage mounted concentrically on the freely rotatable drum and taking the drum with it during its rotation. The cage comprises a section of the drum casing forming the cover member and it closes or opens the filling opening according to the direction of rotation thereof. More particularly, a stop is provided on one side of the filling opening of the drum so that, when the cage rotates in the direction of the stop, the filling opening is closed by the cover, while the position of the other stop is selected so that, when the drum is rotating in the opposite direction, the filling aperture is open. However, such drums cannot be used if the mass-produced parts to be treated are very small. Since the cover must automatically displace itself from the drum casing, large gaps for movement are necessary between the parts of the drum.

The object of the present invention is to construct a loading and unloading station for the chemical and/or electro-chemical treatment of mass-produced parts in a rotating drum so that the cover of the drum is openable by an automatic control system at pre-determined angular positions of the drum.

According to the present invention there is provided a loading and unloading station for the chemical and/or electro-chemical treatment of mass-producing parts contained in a rotatable drum having an axially displaceable cover, and a pressure cylinder which is capable of displacing the cover in a direction parallel to the axis of the drum in a controlled pre-determined angular position of the drum to open or close the cover.

According to a preferred embodiment, the pressure cylinder is arranged on a supporting base with its working piston axially parallel to the drum. This working piston engages on the cover of the drum by means of a driving head. The cover of the drum, formed of plates and axially parallel corner rods, slides over the filling aperture on two corner rods and is guided through a corresponding recess in the front wall of the drum. A hydraulic or pneumatic pressure cylinder can be used for opening but the use of an electro-mechanical drive is also possible.

Such a station according to the present invention permits automatic emptying or filling of the treatment drums. The drum is controlled to stop in a pre-determined angular position. In this position the drum is automatically opened. The use of a sliding cover ensures a very tight closure of the drum opening, so that during the movement of rotation, no mass-produced parts to be treated can come between the cylinder and the cover of the drum. Such a station permits complete automation of chemical and/or electro-chemical treatment systems, as for example, galvanizing systems having a plurality of treatment stations.

The present invention will be described further, by way of example, with reference to the accompanying drawings, in which:

FIG. 1 shows a schematic view of the front elevation of a loading and unloading station comprising the inserted treatment drum;

FIG. 2 shows a plan view of the station according to FIG. 1;

Figure 3:
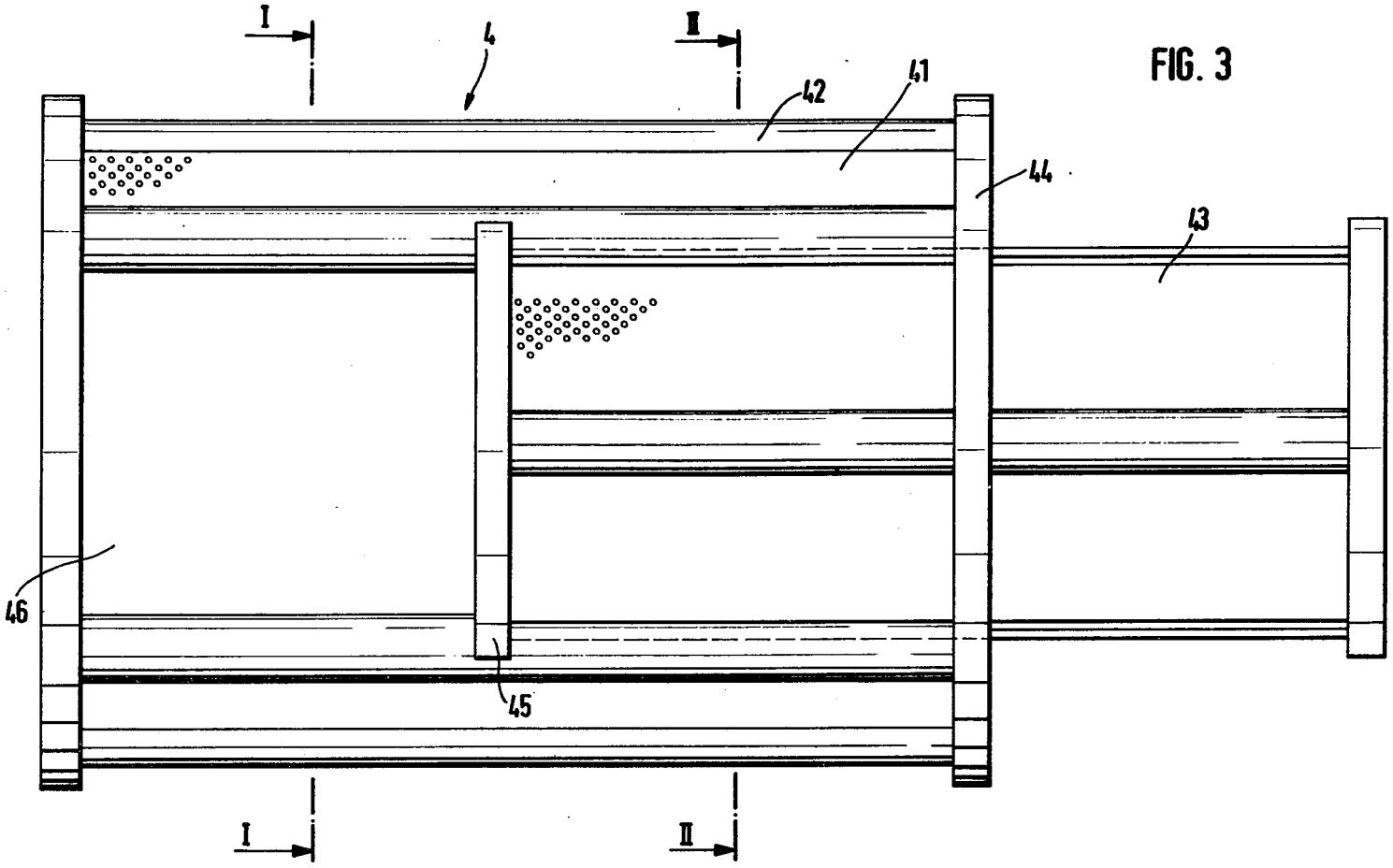
FIG. 3 shows a plan view of a treatment drum.
Figure 4:
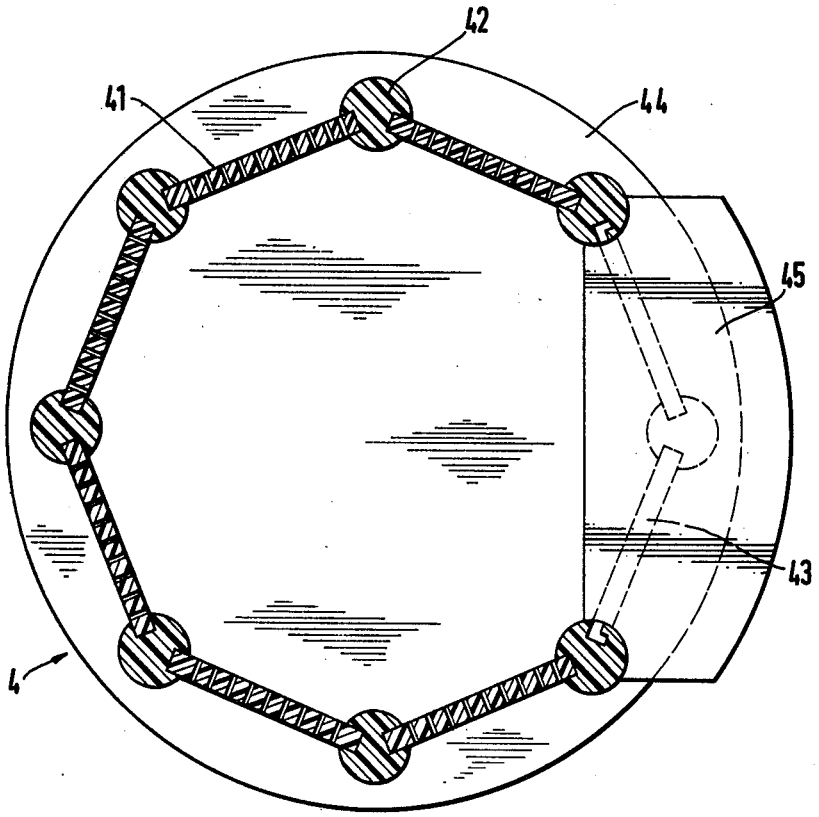
FIG. 4 shows a section taken on the line I—I in FIG. 3.
Figure 5:
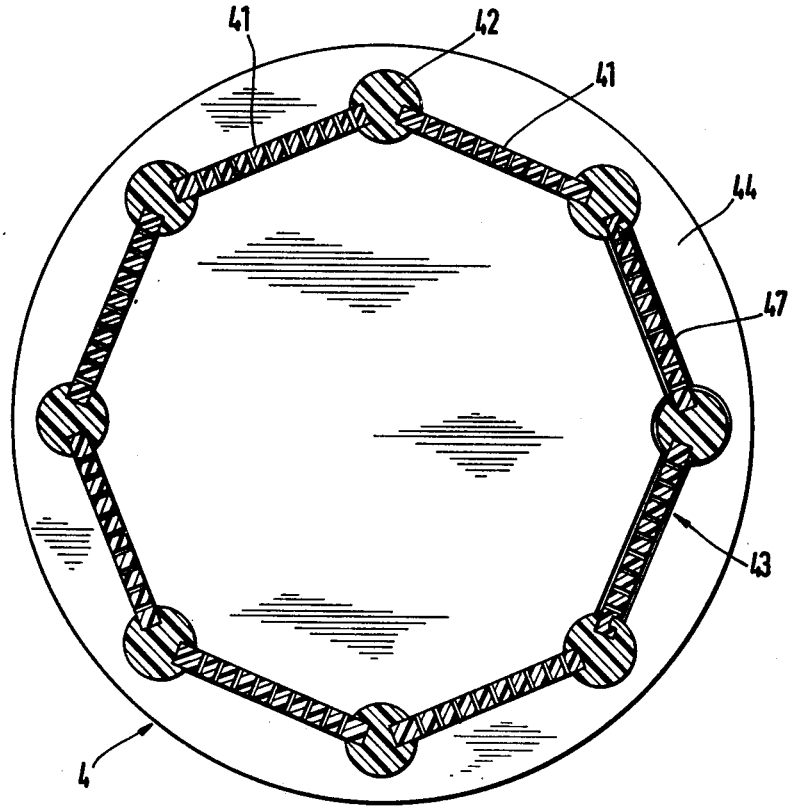
FIG. 5 shows a section taken on the line II—II of FIG. 3.

A treatment drum 4 is mounted on a support stand 1 having a mounted driving frame 2 by means of support arms 3. In the case of chemicals and electro-chemical treatments, such drums are usually made from plastic parts. Between the end walls 44 of the drum 4, a plurality of plates 41, having perforations or corresponding openings, are provided, which plates 41 are connected together by corner rods 42. A filling opening 46 is provided between two corner rods, which opening can be closed or opened by means of the cover 43 which is displaceable in a direction parallel to the axis of the drum. During its movement this cover 43 slides through a suitably shaped guide slot 47 in the end wall 44.

At a controlled, pre-determined angular position of the drum 4, as shown in FIG. 1, a piston 51 of a pneumatic or hydraulic pressure cylinder 5 engages by means of a grooved head 52 a front plate 45 of the cover 43. The cover 43 can thus be displaced in a direction parallel to the axis of the drum 4 for opening or closing the drum aperture 46. The cover 43 and its end plate 45 are free from the engagement of the driving head 52 in the direction of rotation of the drum 4.

The drum 4, suspended on the driving frame 2 by the arms 3, can be displaced away from the effect of the pressure cylinder or its driving piston 51 with the driving head 52. The unloading or the loading station is usually at the beginning or end of a plurality of treatment stations arranged in series.

While only a single embodiment of the invention has been shown and described, it will be obvious to those skilled in the art that many changes and modifications may be made thereunto without departing from the spirit and scope of the invention.

What is claimed is:

1. A loading and unloading station for the chemical and electro-chemical treatment of mass produced parts, comprising:

a support frame;

a drum rotatably mounted on said support frame, said drum comprising a generally tubular sidewall having a filling and dispensing aperture formed therein, and a front and back end wall, each of which is attached to said sidewall at opposite ends thereof and an axially displaceable cover disposed to open and close said aperture of said sidewall; and means for axially displacing said cover in a direction parallel to the axis of said drum, when said drum is in a controlled, predetermined angular position, to thereby permit opening and closing of said aperture, said displacing means comprising a pressure cylinder having an axially displaceable piston, said cylinder being mounted on said support frame, adjacent said front wall of said drum, with its axis parallel to the axis of said drum.

2. The station as recited in claim 1 wherein said cylinder additionally includes a driving head which is configured and dimensioned to engage said cover of said drum, when said drum is in a controlled, predetermined angular position.

3. The station as recited in claim 1 wherein said cover is slidably mounted on said drum, and wherein said front end wall has an opening therein dimensioned and configured to permit passage of said cover therethrough.

4. A loading and unloading station for the chemical and electro-chemical treatment of mass produced parts, comprising:

a support frame;

a drum rotatably mounted on said support frame, said drum comprising a generally tubular sidewall having a filling and dispensing aperture formed therein, and front and back end walls, each of which is attached to said sidewall at opposite ends thereof, and an axially displaceable cover which is slidably mounted on said drum and is disposed to open and close said aperture of said sidewall, said front end wall having an opening therein dimensioned and configured to permit passage of said cover therethrough; and means for axially displacing said cover in a direction parallel to the axis of said drum, when said drum is in a controlled, predetermined angular position, to thereby permit opening and closing of said aperture.

5. The station as recited in claim 4 wherein said displacing means comprises a pressure cylinder having an axially displaceable piston, said cylinder being mounted on said support frame adjacent said front wall of said drum, with its axis parallel to the axis of said drum.

6. The station as recited in claim 5, wherein said cylinder additionally includes a driving head which is configured and dimensioned to engage said cover of said drum, when said drum is in a controlled, predetermined angular position.

7. The station as recited in claim 4 wherein said sidewall comprises a plurality of spaced, axially disposed corner rods, two rods of which define therebetween said aperture and which are configured and dimensioned to slidably engage said cover, and a plurality of plates which interconnect said rods to one another.

* * * * *